US005819454A

United States Patent [19]

Rosenitsch

[11] Patent Number: 5,819,454

[45] Date of Patent: Oct. 13, 1998

[54] DISPLAY DEVICE HAVING TRIANGULAR REFLECTORS

[76] Inventor: Harald Rosenitsch, Anton Langergasse23, A-1130, Vienna, Austria

[21] Appl. No.: 666,545

[22] PCT Filed: Dec. 29, 1994

[86] PCT No.: PCT/AT94/00209

§ 371 Date: Jun. 26, 1996

§ 102(e) Date: Jun. 26, 1996

[87] PCT Pub. No.: WO95/18435

PCT Pub. Date: Jul. 6, 1995

[30] Foreign Application Priority Data

Dec. 30, 1993 [AT] Austria ..... 2652/93

[51] Int. Cl.[6] ..... G09F 3/04

[52] U.S. Cl. ..... 40/524; 40/452; 362/240; 362/241; 340/815.45; 340/815.5; 345/82

[58] Field of Search ..... 40/452, 550; 362/240, 362/241, 243, 247, 283, 800, 812; 340/815.45, 815.49, 815.9; 345/82

[56] References Cited

U.S. PATENT DOCUMENTS

| | | | |
|---|---|---|---|
| 4,254,453 | 3/1981 | Mouyard et al. | 40/500 X |
| 4,783,920 | 11/1988 | Muller-Tolk | 40/550 |

FOREIGN PATENT DOCUMENTS

| | | | |
|---|---|---|---|
| 0 400 176 | 12/1990 | European Pat. Off. . | |
| 0 303 741 | 2/1992 | European Pat. Off. . | |
| 548758 | 1/1923 | France | 40/452 |
| 2 434 477 | 3/1980 | France . | |

*Primary Examiner*—Cassandra Davis
*Attorney, Agent, or Firm*—Herbert Dubno

[57] ABSTRACT

A display device in which the grid formed by rectangular reflector elements has each element divided by at least one diagonal into at least two triangular reflectors at the base of which at least one light source is provided and which is closed by a respective diffuser. The diffusers are held in place by light-tight settings surrounding the diffusers. The result is a display with a particularly high definition capable of proportional display of alphanumeric characters.

2 Claims, 4 Drawing Sheets

DISPLAY DEVICE HAVING TRIANGULAR REFLECTORS

CROSS REFERENCE TO RELATED APPLICATIONS

This application is a national stage of PCT/1894/00209 filed 29 Dec. 1994 and based, in turn, on Austrian National Application a 2652/93 filed 30 Dec. 1993 under the International Convention.

FIELD OF THE INVENTION

The invention relates to a display device with a grid-shaped body having a plurality of reflectors and having an electrically excitable light source, whereby each reflector is covered with a diffusing plate shaped like a lens.

BACKGROUND OF THE INVENTION

In a display device of this kind known from DE-A1-29 32 413, the grid-like body is formed by round reflectors arranged next to each other at equal distances, which are provided with a light source. The diffusing plates, designed as retro-reflectors, arranged in a plate-like component, which reaches over the edges of the grid-like body.

On the one hand this translates into relatively quite thick display devices. On the other hand the individual diffusing lenses interfere with each other, which results in unclear displays.

OBJECT OF THE INVENTION

It is the particular object of the invention to provide a display device whose thickness is reduced in comparison to the known display devices and wherein the displayed symbol groups are more easily readable.

SUMMARY OF THE INVENTION

This object is attained in that at its end opposite to the light source each reflector has a light-proof mounting for the individual diffusing plates.

In a preferred embodiment of the invention the grid of the grid-shaped body is formed by rectangles, preferably squares, each of which is subdivided into triangles by at least one diagonal, whereby each triangle forms the end covered by a diffusing plate of a reflector provided with a light source.

The legibility of the displayed symbol group is increased by the fact that the diffusing plates have a lens-shaped arch concave towards the light source.

In order to achieve a multicolored display, the light sources and/or the diffusing plates can have various colors.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
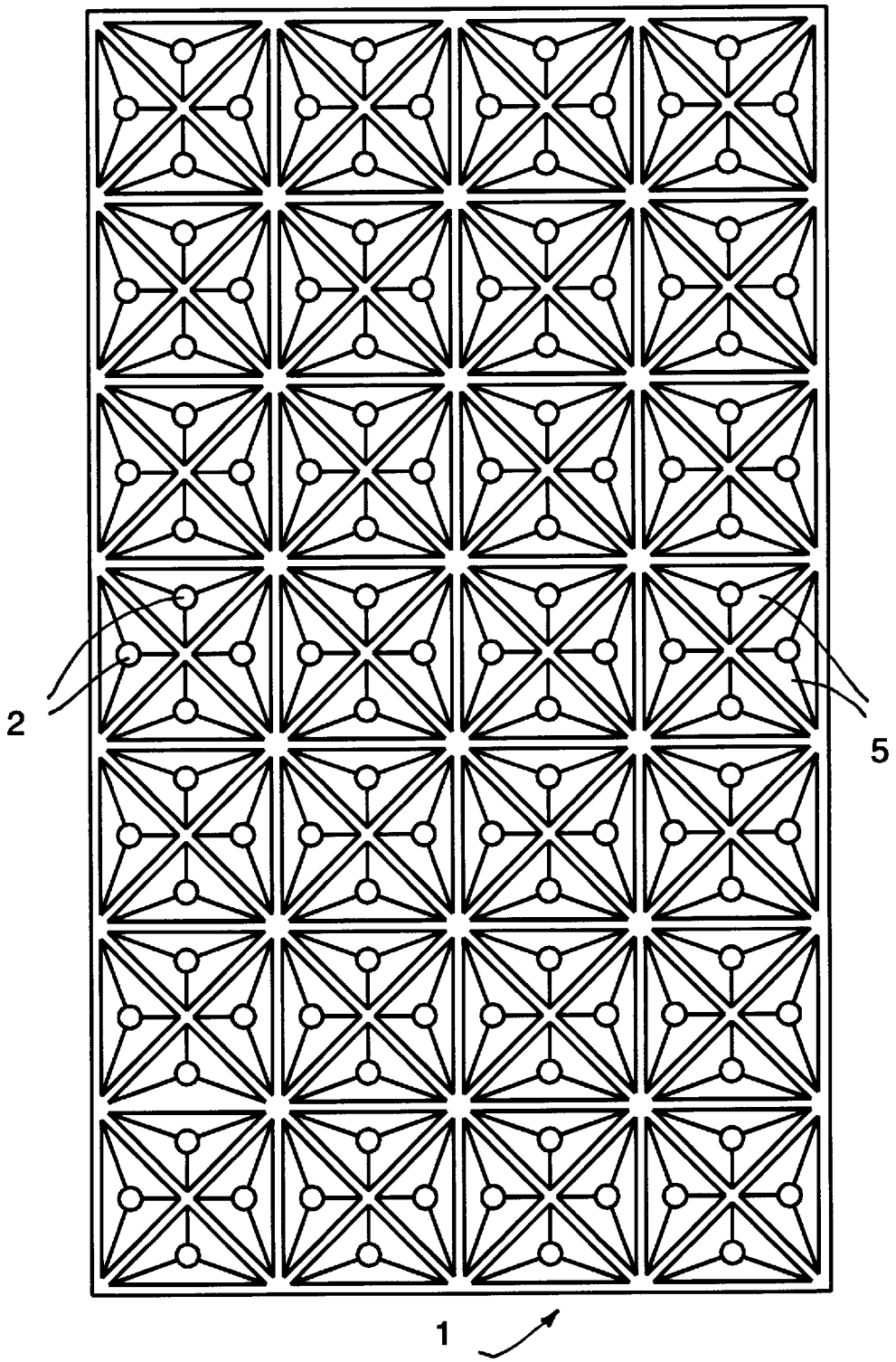
FIG. 1 is a plan view of a display device according to the invention.
Figure 2:
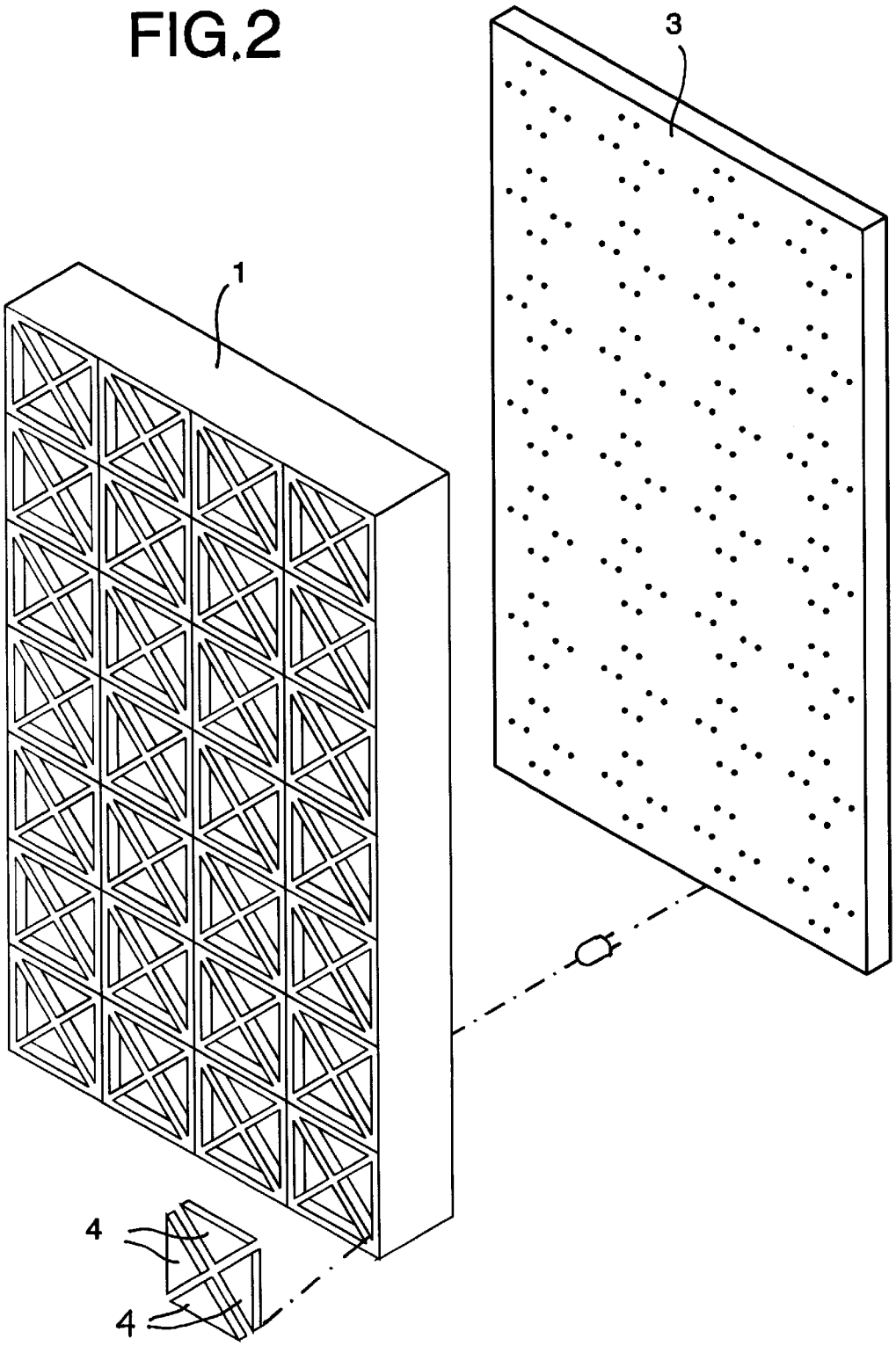
FIG. 2 is an exploded perspective view of the display device according to FIG. 1 with the individual parts shown separately from each other and a grid element shown in detail.
Figure 3:
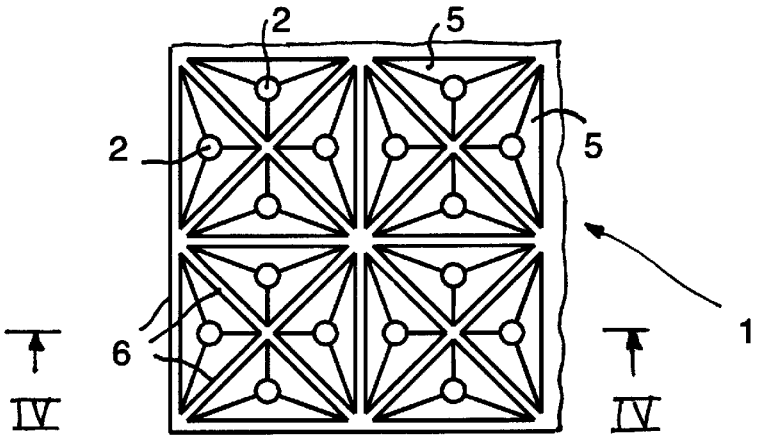
FIG. 3 is an enlarged representation of a part of the display device according to FIG. 1.

According to FIGS. 1 to 4 a display device consists basically of a grid-shaped body 1, a light source 2, which is mounted on a device 3 for the supply of electric current, e.g. a printed circuit board, and lens-shaped diffusing plates 4. The grid of the grid-shaped body 1 is formed by squares in the embodiment example shown in the drawing, each of these squares being subdivided into four triangles by two diagonals (FIG. 2). Thereby in a plan view triangular structures are created, whose inwardly extending walls are shaped like pyramidal reflectors 5, whereby in the area of the respective apex of each pyramid a light source is located.

At its end opposite to the light source 2, each reflector 5 forms a light-proof setting for the respective diffusing plate 4.

The diffusing plates 4 are pressed into the grid-shaped body 1, i.e. into each of the provided settings or seats 6. The thin, about 0.5 mm thick, light-proof webs forming the settings 6 between the adjacent diffusing plates 4, prevent transitional emission of radiation at the edges of the plates 4. The diffusing plates 4 are provided with lens-shaped arch 7 at their surfaces facing the light source 2 for the purpose of an even light distribution.

Due to the design according to the invention an "LCD effect" is achieved, without the disadvantages of the conventional LCD displays. The subdivision of a script surface with freely selectable dimensions into a large number of grid units makes possible the presentation of all script symbols, and also the presentation of running inscriptions. A further substantial advantage of the system of the invention is the possibility of providing inscriptions over the entire script surface (e.g. ten symbols 200 mm high or two lines with at least twenty symbols 90 mm high). Proportional script may also be displayed, as shown in FIG. 6.

Figure 5:
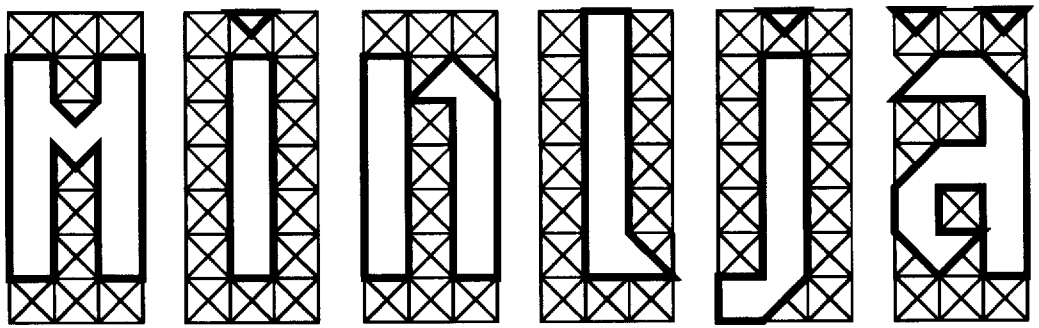
FIG. 5 is an example of a display with a conventional display device.
Figure 6:
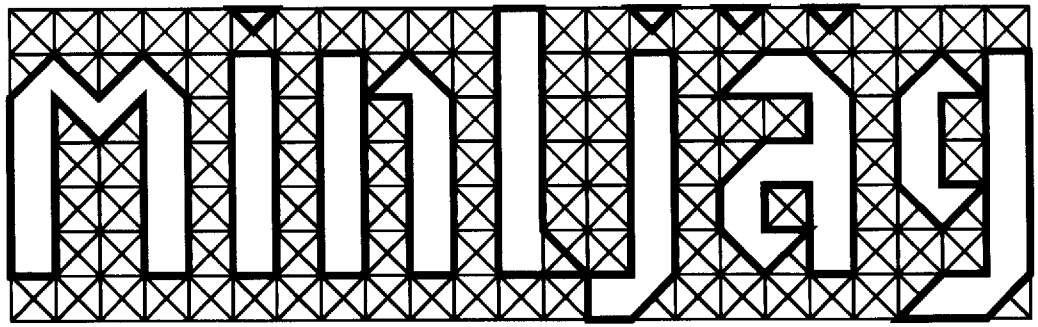
FIG. 6 is a display with the display device of the invention by using proportional script.

A comparison of FIG. 5 and FIG. 6 will show the advantage of the system according to the invention over the conventional LCD technique. FIG. 5 shows the heretofore used subdivision of LCD lenses with the central webs necessary for conductor tracks. By contrast, FIG. 6 shows a display according to the invention, in which proportional script may be used.

Figure 7:
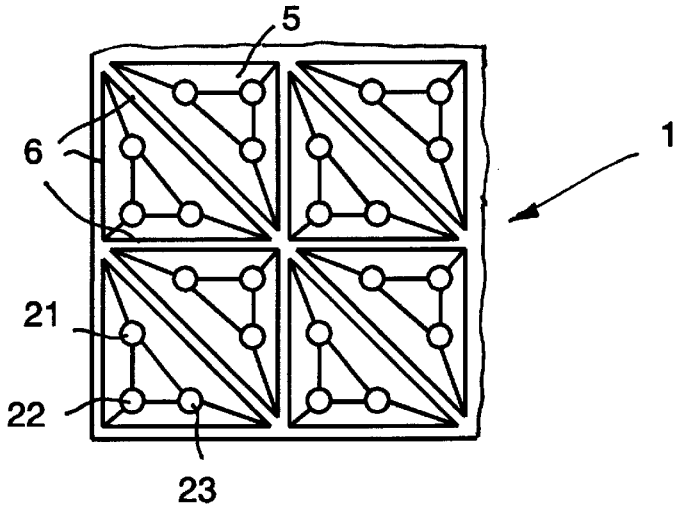
FIG. 7 is a further embodiment of the invention shown in a representation similar to that of FIG. 3.
Figure 4:
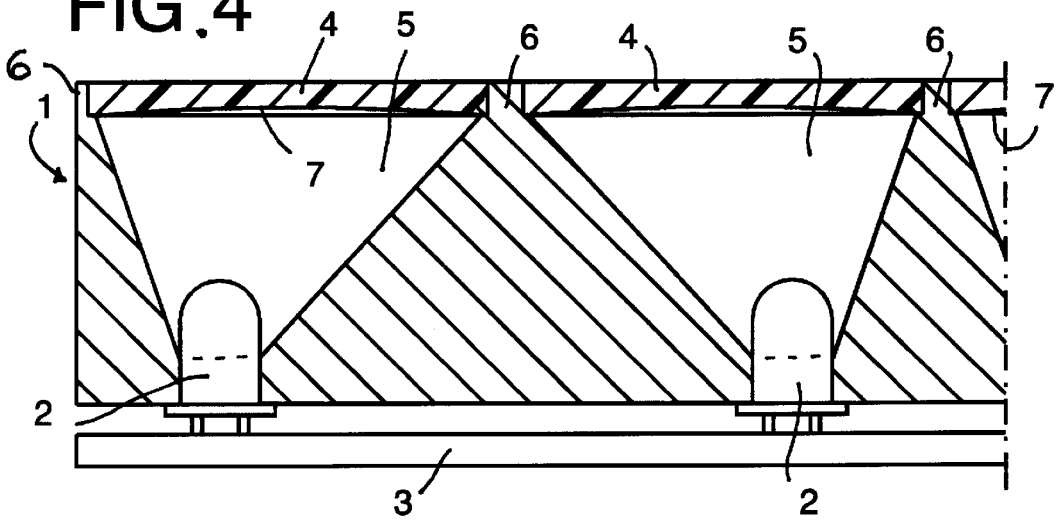
FIG. 4 is a section along line IV—IV in FIG. 3.

In FIG. 7 a further embodiment of the invention is illustrated, whereby the squares are subdivided only by one diagonal into two triangles and in the created pyramidal reflector three light sources 21, 22 and 23 are arranged, which can have different colors.

I claim:

1. A display device comprising:

a body formed as a grid of rectangular reflector elements each subdivided by at least one diagonal into at least two triangular reflectors, each of said triangular reflectors being defined by walls which diverge from one side of the body at a narrow end of a respective triangular reflector to an opposite side of the body at a wide end of the respective triangular reflectors;

at least one light source respectively provided at the narrow end of each of said triangular reflectors;

a respective diffuser extending across to the wide end of each triangular reflector; and a respective light-tight setting receiving each of said diffusers at the respective wide ends and bordering the respective diffuser for retaining the respective diffuser.

2. The display device defined in claim 1 wherein each of said diffusors is concave toward the respective light source.

* * * * *